US009546805B2

(12) United States Patent
Herbert et al.

(10) Patent No.: US 9,546,805 B2
(45) Date of Patent: Jan. 17, 2017

(54) COOLANT CONDENSER ASSEMBLY

(75) Inventors: Hofmann Herbert, Stuttgart (DE); Uwe Förster, Erdmannhausen (DE); Walter Christoph, Stuttgart (DE); Guillaume David, Rocheser, MI (US); Kaspar Martin, Fellbach (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 962 days.

(21) Appl. No.: 13/819,739

(22) PCT Filed: Jul. 28, 2011

(86) PCT No.: PCT/EP2011/063008

§ 371 (c)(1),
(2), (4) Date: May 13, 2013

(87) PCT Pub. No.: WO2012/028398

PCT Pub. Date: Mar. 8, 2012

(65) Prior Publication Data

US 2013/0219953 A1 Aug. 29, 2013

(30) Foreign Application Priority Data

Aug. 31, 2010 (DE) ..... 10 2010 040 025

(51) Int. Cl.
*F25B 39/04* (2006.01)
*F28D 1/053* (2006.01)
(Continued)

(52) U.S. Cl.
CPC ..... *F25B 39/04* (2013.01); *F25B 40/00* (2013.01); *F28B 9/08* (2013.01); *F28D 1/053* (2013.01);
(Continued)

(58) Field of Classification Search
CPC ..... F25B 39/04; F25B 40/00; F25B 40/04; F25B 2339/0441; F25B 40/02; F25B 2500/01; F25B 2339/044; F25B 43/00; F25B 43/003; F25B 2400/162; F25B 2400/16; F25B 2400/161; F28D 1/053; F28D 2021/0084; F28B 9/08
(Continued)

(56) References Cited

U.S. PATENT DOCUMENTS 7,036,336 B2 5/2006 Bellott et al.
7,836,725 B2 11/2010 Lautner et al.
(Continued)

FOREIGN PATENT DOCUMENTS

DE 10 2004 043 133 A1 3/2006
DE 10 2005 005 187 A1 8/2006
(Continued)

OTHER PUBLICATIONS

International Search Report, PCT/EP2011/063008, Feb. 10, 2012, 3 pgs.
(Continued)

*Primary Examiner* — Ryan J Walters
*Assistant Examiner* — Steve Tanenbaum
(74) *Attorney, Agent, or Firm* — Paul D. Strain, Esq.; Strain & Strain PLLC

(57) ABSTRACT

In a coolant condenser assembly for a motor vehicle air conditioning system, comprising cooling pipes for conducting a coolant through, two collecting pipes for fluidically connecting the cooling pipes, a collecting container with an upper cover wall and a lower bottom wall and a side wall as well as with an inlet opening for conducting the coolant into the collecting container and an outlet opening for conducting
(Continued)

the coolant out of the collecting container, with the result that through the inlet and outlet openings the collecting container is fluidically connected to the collecting pipe and/or the cooling pipes, the collecting container comprises an outlet chamber and a riser pipe, and the outlet opening opens into the outlet chamber, and the outlet chamber is connected to the riser pipe and a storage chamber for the coolant is formed within the collecting container and outside the outlet chamber and outside the riser pipe, the collecting container preferably has an inlet chamber and a downpipe, and the inlet opening opens into the inlet chamber and the inlet chamber is connected to the downpipe and the storage chamber is formed outside the inlet chamber and outside the downpipe, the cooling pipes have a superheating region for cooling the vaporous coolant, a condensation region for condensing the coolant and a supercooling region for cooling the liquid coolant, wherein the supercooling region is formed above the superheating region and above the condensation region, the intention is that little coolant will be present in flow spaces in the collecting container. This object is achieved in that the height of the storage chamber is greater than the distance between the lower floor wall and the inlet and/or outlet openings.

8 Claims, 5 Drawing Sheets

(51) Int. Cl.

| | |
|---|---|
| ***F25B 40/00*** | (2006.01) |
| ***F28B 9/08*** | (2006.01) |
| *F25B 40/02* | (2006.01) |
| *F25B 40/04* | (2006.01) |
| *F28D 21/00* | (2006.01) |

(52) U.S. Cl.
CPC ..... *F25B 40/02* (2013.01); *F25B 40/04* (2013.01); *F25B 2339/0441* (2013.01); *F25B 2500/01* (2013.01); *F28D 2021/0084* (2013.01)

(58) Field of Classification Search
USPC ..... 62/509
See application file for complete search history.

(56) References Cited

U.S. PATENT DOCUMENTS

| | | | | |
|---|---|---|---|---|
| 2005/0072184 | A1* | 4/2005 | Operschall | F25B 39/04 62/474 |
| 2006/0185385 | A1* | 8/2006 | Feldhaus | F25B 39/04 62/509 |
| 2006/0254310 | A1* | 11/2006 | Kamsma | F25B 39/04 62/509 |
| 2010/0147019 | A1* | 6/2010 | Kaspar | F25B 39/04 62/474 |

FOREIGN PATENT DOCUMENTS

| | | | |
|---|---|---|---|
| DE | 10 2005 025 451 | A1 | 12/2006 |
| DE | 10 2007 009 923 | A1 | 8/2008 |
| EP | 1 522 804 | A1 | 4/2005 |
| JP | 57-128067 | U | 8/1982 |
| JP | 5-306857 | A | 11/1993 |
| JP | 9-53866 | A | 2/1997 |
| JP | 9-166371 | A | 6/1997 |
| JP | 9-178301 | A | 7/1997 |
| JP | 2005-513408 | A | 5/2005 |
| JP | 2006-214714 | A | 8/2006 |
| JP | 2008-529877 | A | 8/2008 |

OTHER PUBLICATIONS

German Search Report, DE 10 2010 040 025.4, Jun. 10, 2011, 5 pgs.

* cited by examiner

COOLANT CONDENSER ASSEMBLY

CROSS-REFERENCE TO RELATED PATENT APPLICATIONS

This application is a National Stage of International Application No. PCT/EP2011/063008, filed Jul. 28, 2011, which is based upon and claims the benefit of priority from prior German Patent Application No. 10 2010 040 025.4, filed Aug. 31, 2010, the entire contents of all of which are incorporated herein by reference in their entirety.

The present application relates to a refrigerant condenser assembly and to a motor vehicle air-conditioning system.

In refrigerant condenser assemblies for a motor vehicle air-conditioning system, vaporous refrigerant is changed into a liquid state of aggregation, and the liquid refrigerant is subsequently "supercooled" further in a supercooling region. The refrigerant condenser assembly forms a part of a refrigeration circuit of a motor vehicle air-conditioning system with an evaporator, an expansion element and a compressor. Here, the refrigerant condenser assembly comprises a heat exchanger with cooling tubes and with two collecting tubes and additionally with a collecting tank. The collecting tank has the task, after the condensation of the refrigerant in the condensation region and the preceding cooling in the superheat region, of separating off any gaseous refrigerant fraction that may be present, and ensuring that only liquid refrigerant is supplied, after exiting the collecting tank, to the supercooling region, positioned hydraulically downstream of the collecting tank, of the heat exchanger. Here, the supercooling region is formed on the heat exchanger with the cooling tubes and the two collecting tubes. Liquid refrigerant is arranged in the collecting tank, and the outlet opening in the collecting tank (collecting tank without ascending tube) is arranged at the lowermost point of the collecting tank in order that only liquid refrigerant is discharged from the collecting tank. In general, the supercooling region of the heat exchanger is situated in the lower portion of the heat exchanger, such that the outlet opening on the collecting tank is thus correctly aligned.

Owing to external conditions in a motor vehicle, for example a charge-air cooler positioned in front of the heat exchanger of the refrigerant condenser assembly, it is necessary for the supercooling region to be formed not at be bottom but rather in the upper region of the heat exchanger or of the refrigerant condenser assembly, because the charge-air cooler is to be arranged in the lower region. In an arrangement of said type, it is necessary for the refrigerant discharged from the collecting tank at the lowermost point to be conducted upward through an ascending tube within the collecting tank and to be discharged from an outlet opening, and supplied to the supercooling region, in the upper region of the collecting tank. Said ascending tube is generally formed as a plastic insert part which, in addition to the flow guidance, may also perform other tasks within the collecting tank, for example filtering and/or drying. The liquid refrigerant stored in the collecting tank must, for correct functioning, form a calm liquid surface. To achieve this, it is necessary for the refrigerant introduced into the collecting tank to be introduced below the liquid surface. If, owing to the type of construction, the inlet opening of the collecting tank is arranged in the upper region of the collecting tank, it is therefore necessary for refrigerant introduced into the collecting tank at the inlet opening to be introduced below the liquid surface of the refrigerant in the collecting tank through a downwardly oriented tube, that is to say a descending tube. Here, the refrigerant at the inlet opening is not introduced directly into the descending tube but rather is initially introduced into an inlet chamber, and the refrigerant, that has been conducted upward, from the ascending tube is initially introduced into an outlet chamber, and the refrigerant flows out of the outlet chamber through the outlet opening out of the collecting tank. Here, owing to production conditions, the diameters of the ascending tube and of the descending tube and the volumes of the inlet chamber and of the outlet chamber are designed to be significantly greater than is required for flow guidance. As a result, more refrigerant is present in the collecting tank in the flow spaces than is actually required for flow guidance.

DE 10 2005 025 451 A1 presents a condenser for an air-conditioning system, in particular for motor vehicles, comprising a condensing portion, comprising a supercooling portion arranged above the condensing portion, comprising an approximately tubular modulator which is divided by a partition into a lower portion, which is connected to the condensing portion, and an upper portion, which is connected to the supercooling portion, comprising an ascending tube between the lower and the upper portion of the modulator, and comprising a container for drying agent in the lower portion of the modulator, wherein the modulator is provided, on the top side, with a closure plug, and the partition together with the drying agent container can be removed from the modulator in the upward direction after the closure plug is removed.

DE 10 2007 009 923 A1 discloses a condenser for an air-conditioning system, in particular of a motor vehicle, having a tube-fin block and having laterally arranged collecting tubes. The tube-fin block has horizontally running tubes, a condensing portion and a supercooling portion arranged above the condensing portion, said tube-fin block also having a collector which is arranged parallel to one of the collecting tubes and which has a dryer, a filter, a descending tube and an ascending tube, which collector has a refrigerant connection to the condensing portion via a first flow transfer opening and to the supercooling portion via a second flow transfer opening, wherein the descending tube communicates at the inlet side with the first flow transfer opening via an inflow chamber arranged in the collector.

It is therefore the object of the present invention to provide a refrigerant condenser assembly and a motor vehicle air-conditioning system in which, in the collecting tank, there is a small amount of refrigerant present in flow spaces.

Said object is achieved by means of a refrigerant condenser assembly for an air-conditioning system, comprising cooling tubes for conducting a refrigerant, two collecting tubes for fluidically connecting the cooling tubes, a collecting tank having an upper top wall and lower base wall and having a side wall and also having an inlet opening for the introduction of the refrigerant into the collecting tank and an outlet opening for the discharge of the refrigerant from the collecting tank, such that the collecting tank is fluidically connected to the collecting tube and/or to the cooling tubes by means of the inlet and outlet opening, the collecting tank comprises an outlet chamber and an ascending tube, and the outlet opening issues into the outlet chamber, and the outlet chamber is connected to the ascending tube, and an accumulator chamber for the refrigerant is formed within the collecting tank and outside the outlet chamber and outside the ascending tube, preferably, the collecting tank comprises an inlet chamber and a descending tube, and the inlet opening issues into the inlet chamber, and the inlet chamber is connected to the descending tube, and the accumulator chamber is formed outside the inlet chamber and outside the descending tube, the cooling tubes have a superheat region for cooling the vaporous refrigerant, a condensation region for condensing the refrigerant, and a supercooling region for cooling the liquid refrigerant, wherein the supercooling region is formed above the superheat region and above the condensation region, wherein the height of the accumulator chamber is greater, in particular 1.1, 1.2 or 1.5 times greater, than the spacing between the lower base wall and the inlet and/or outlet opening, and/or the ratio of the sum of the volumes of the inlet chamber, of the outlet chamber, of the descending tube and of the ascending tube to the height (L) of the collecting tank is less than 170.

The collecting tank of the refrigerant condenser assembly thus contains only a small amount of refrigerant in the flow spaces of the refrigerant condenser assembly, that is to say the inlet chamber, the outlet chamber, the ascending tube and the descending tube. As a result, if the expensive refrigerant HFO 1234yf is used, it is possible for costs to be saved in the production of the refrigerant condenser assembly or of a motor vehicle air-conditioning system having the refrigerant condenser assembly, because the collecting tank contains only a very small amount of refrigerant.

In an additional embodiment, the ratio of the sum of the volume of the inlet chamber, of the outlet chamber, of the descending tube and of the ascending tube to the height of the collecting tank is less than 100, 120 or 140.

In an additional embodiment, the inlet opening and/or the outlet opening are/is formed in the upper half, in particular in the upper third, of the collecting tank.

In a supplementary embodiment, the cooling tubes are in the form of flat tubes and/or corrugated fins are formed between the cooling tubes and/or the upper top wall and/or the lower base wall are/is formed as a closure plug and/or the outlet opening issues into the supercooling region and/or the inlet opening issues into the condensation region.

In a supplementary variant, the top wall and/or the base wall as a closure plug are/is detachably or non-detachably connected to the side wall of the collecting tank.

In a supplementary embodiment, the side wall is composed at least partially, in particular entirely, of metal, for example aluminum or steel.

In an additional embodiment, the top wall and/or the base wall and/or the ascending tube and/or the descending tube are/is formed at least partially, in particular entirely, of plastic.

In an additional embodiment, the ascending tube and/or the descending tube and/or the inlet tube and/or the outlet tube are/is produced by means of extrusion, or the ascending tube and/or the descending tube and/or the inlet tube and/or the outlet tube are/is produced from two half-shells. It is thereby possible for the ascending tube and/or the descending tube to be produced with a very small flow cross-sectional area.

In an additional embodiment, the ascending tube and/or the descending tube and/or the top wall and/or the base wall are/is composed of metal, for example aluminum or steel.

In a supplementary embodiment, the height of the accumulator chamber substantially corresponds to the spacing between the upper top wall and the lower base wall and/or the accumulator chamber is delimited by the upper top wall and lower base wall and/or the accumulator chamber extends from the upper top wall to the lower base wall. The accumulator chamber is enclosed by the walls of the collecting tank, specifically the side wall, the top wall and the base wall, and here, the accumulator chamber is formed outside the ascending tube and the descending tube and outside the inlet chamber and the outlet chamber and within the collecting tank. Here, the accumulator chamber is preferably formed entirely between the top wall and the base wall, such that in a horizontal section through the collecting tank, there are no sections in which the cross-sectional shape of the inlet chamber and/or outlet chamber corresponds to the cross-sectional shape of the side wall, and/or in the horizontal section, the cross-sectional areas of the inlet chamber and/or of the outlet chamber are smaller, in particular smaller by a multiple of 0.9, 0.7 or 0.5, than the cross-sectional area of the collecting tank or of the side wall.

In an additional embodiment, the side wall is in the form of a tube, in particular a tube which is circular or rectangular in cross section, and is closed off in a fluid-tight manner at the top end and at the bottom end by the top wall and by the base wall.

In an additional embodiment, in a horizontal section at the inlet opening, the accumulator chamber is formed at said horizontal section, and/or in a horizontal section at the outlet opening, the accumulator chamber is formed at said horizontal section.

In an additional embodiment, the flow cross-sectional area of the ascending tube and/or of the descending tube is less than 200 $mm^2$, in particular less than 80 $mm^2$ or 100 $mm^2$, and/or the inner diameter of the ascending tube and/or of the descending tube is less than 8 mm or 7 mm and/or the flow cross-sectional area of the ascending tube and/or of the descending tube is between 27 $mm^2$ and 80 $mm^2$, in particular, the inner diameter of the ascending tube and/or of the descending tube is between 3 mm and 5 mm. The ascending tube and the descending tube enclose a flow space and the flow space is small owing to the small flow cross-sectional area of the ascending and descending tubes, and as a result, only a small volume of refrigerant is arranged in the flow space of the collecting tank. It is thus possible to save on the expensive refrigerant HFO 1234yf.

In one variant, the inlet chamber and/or the outlet chamber are/is filled with a dryer granulate, and the volume of the inlet chamber corresponds to the flow space for the refrigerant in the inlet chamber outside the dryer granulate, and/or the volume of the outlet chamber corresponds to the flow space for the refrigerant in the outlet chamber outside the dryer granulate. The inlet chamber and the outlet chamber are delimited by walls, for example the side wall, and by separating disks. Here, the volume of the inlet chamber or of the outlet chamber is regarded as being only that volume which is available as a flow space for the refrigerant. Therefore, if the inlet or outlet chamber is partially filled with dryer granulate, the volume of the inlet chamber corresponds to the space of the volume enclosed by the walls of the inlet chamber minus the volume of the dryer granulate. Owing to the arrangement of dryer granulate in the inlet and outlet chambers, said chambers therefore have a relatively small flow space and thus also, as per the above definition, a small volume, such that as a result, only a small amount of refrigerant is required or stored in the inlet and outlet chambers in the collecting tank. This also applies analogously to the arrangement of other components, for example a filter, in the inlet chamber and/or outlet chamber. Furthermore, this also applies analogously to the volume of the descending tube and/or ascending tube if a component, for example dryer granulate or a dryer or a filter, is arranged therein.

In a further embodiment, the inlet chamber is formed as a first inlet annular chamber, and/or the outlet chamber is formed as an outlet annular chamber, between the side wall and a tube piece, and preferably, at least two seals, in particular sealing rings, are arranged between the side wall and the tube piece in order to provide sealing between the inlet annular chamber and the accumulator chamber and/or between the outlet annular chamber and the accumulator chamber and/or between the inlet annular chamber and the outlet annular chamber.

In a supplementary variant, the inlet chamber is formed as an inlet tube and/or the outlet chamber is formed as an outlet tube.

It is expedient for a filter to be arranged on the ascending tube, in particular on a lower end of the ascending tube.

Motor vehicle air-conditioning system according to the invention, comprising a refrigerant condenser assembly, an evaporator, a compressor, preferably a fan, preferably a housing for accommodating the fan and the evaporator, preferably a heating device, wherein the refrigerant condenser assembly is designed as a refrigerant condenser assembly as described in this property right application.

In an additional embodiment, the refrigerant is HFO 1234yf or R134a.

An exemplary embodiment of the invention will be described in more detail below with reference to the appended drawings, in which.

Figure 1:
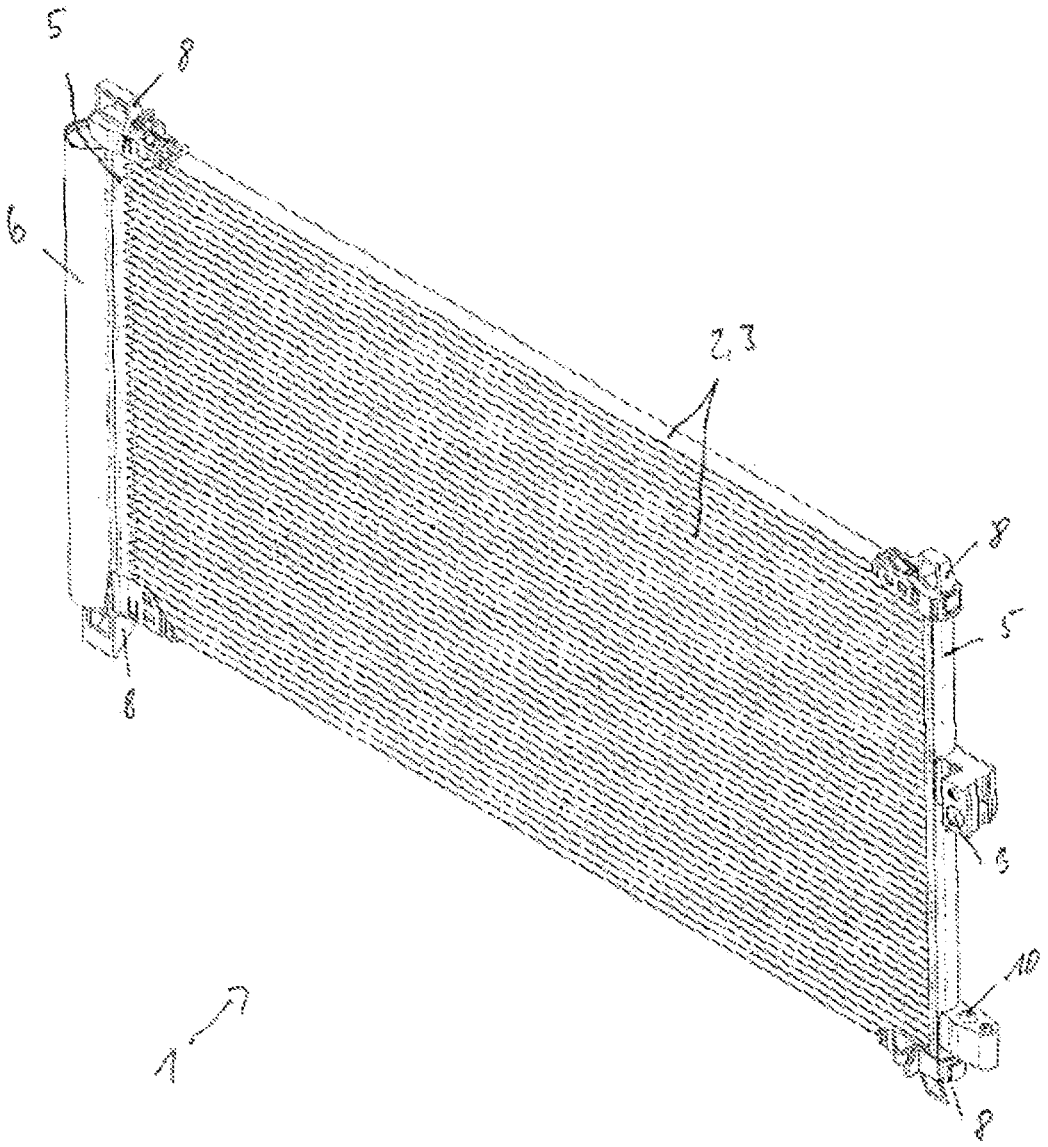
FIG. 1 shows a perspective view of a refrigerant condenser assembly.
Figure 2:
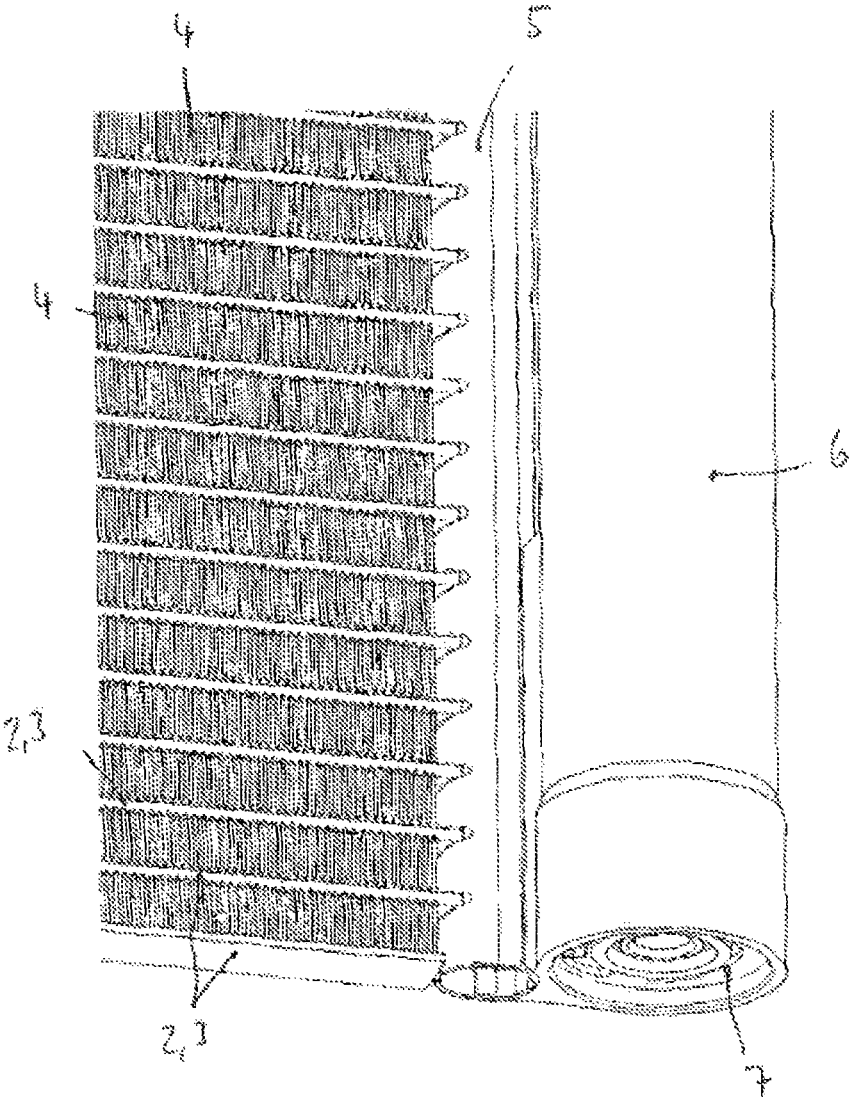
FIG. 2 shows a perspective partial view of the refrigerant condenser assembly as per FIG. 1.

FIGS. 1 and 2 illustrate a refrigerant condenser assembly 1 in a perspective view. The refrigerant condenser assembly 1 is a constituent part of a motor vehicle air-conditioning system with an evaporator and a compressor (not illustrated). Refrigerant to be condensed and to be cooled flows through horizontally arranged cooling tubes 2 as flat tubes 3 (FIGS. 1 and 2). The cooling tubes 2 issue at their respective ends into a vertical collecting tube 5, that is to say two collecting tubes 5 are provided, in each case on the ends of the cooling tubes 2. Only one collecting tube 5 is illustrated in FIG. 2. For this purpose, the collecting tube 5 has cooling tube openings through which the ends of the cooling tubes 2 project into the collecting tube 5. Within the collecting tubes 5 there are formed guiding plates 17 (FIG. 5) by means of which a defined flow path of the refrigerant through the cooling tubes 2 can be realized.

Between the cooling tubes 2 there are arranged meandering corrugated fins 4 which are thermally connected to the cooling tubes 2 by means of heat conduction. In this way, the surface area available for cooling the refrigerant is enlarged. The cooling tubes 2, the corrugated fins 4 and the two collecting tubes 5 are generally composed of metal, in particular aluminum, and are connected to one another cohesively by means of a brazed connection. In four corner regions of the refrigerant condenser assembly 1 there is arranged a fastening device 8 by means of which the refrigerant condenser assembly 1 can be fastened to a motor vehicle, in particular to a body of a motor vehicle.

On the collecting tube 5 there is arranged a collecting tank 6 which is likewise oriented vertically (FIGS. 1, 2). The collecting tank 6 is fluidically connected via an inlet and an outlet opening 18, 19 (FIGS. 3 to 5) to the collecting tube 5 and is thus also indirectly fluidically connected to the cooling tubes 2. The collecting tank 6 has a side wall 20 of substantially circular cross section as a tube, has an upper top wall 21 and has a lower base wall 22, which walls enclose a fluid-tight space. The top wall 21 and the base wall 22 are formed, as closure plugs 23, from plastic. Here, the lower closure plug 23 is detachably connected to the side wall 20 composed of aluminum, in order to allow maintenance work, for example the exchange of a filter 16, to be performed.

The refrigerant condenser assembly 1 has an assembly inlet opening 9 for the introduction of the refrigerant HFO 1234yf into the refrigerant condenser assembly 1 and has an assembly outlet opening 10 for the discharge of the refrigerant from the refrigerant condenser assembly 1 (FIG. 1). Here, the ends of the cooling tubes 2 terminate in the collecting tubes 5. In the collecting tubes 5 there are arranged guiding plates 17 or flow guiding plates 17 (FIG. 5) by means of which a certain predefined flow configuration of the refrigerant can be realized, that is to say on which flow path the refrigerant flows through the multiplicity of cooling tubes 2, arranged one above the other, of the refrigerant condenser assembly 1.

The refrigerant condenser assembly 1 constitutes a heat exchanger for the transfer of heat from the refrigerant to air which surrounds and flows around and through the refrigerant condenser assembly 1. Here, the heat exchanger is formed substantially by the cooling tubes 2 and the two collecting tubes 5. The gaseous refrigerant is conducted from a compressor (not illustrated) to the refrigerant condenser assembly 1 through the assembly inlet opening 9. Here, the gaseous refrigerant is cooled, at a superheat region 11, to a saturation temperature, that is to say, at the saturation temperature, a condensation of the refrigerant occurs corresponding to the prevailing pressure. The superheat region 11 is followed, downstream in the flow direction of the refrigerant, by a condensation region 12 in which the refrigerant is condensed and thus liquefied. The refrigerant which is liquefied in the condensation region 12 is supplied as liquid to the collecting tank 6 through the inlet opening 18, is subsequently discharged from the collecting tank 6 and supplied to the supercooling region 13 through an outlet opening 19, and in the supercooling region 13 is cooled below the boiling temperature of the refrigerant. Here, the supercooling region 13 is arranged above the superheat region 11 and above the condensation region 12, which are formed substantially by the cooling tubes 21.

Figure 3:
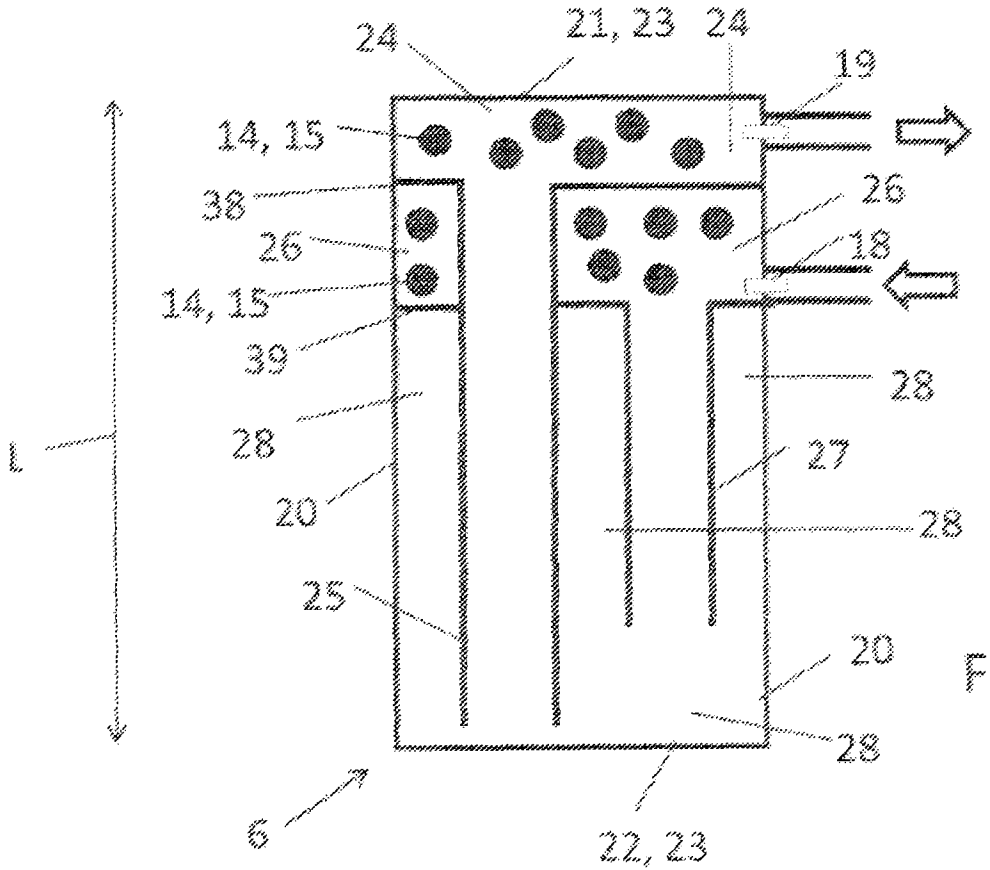
FIG. 3 shows a longitudinal section of a collecting tank in a first exemplary embodiment.

FIG. 3 illustrates a first exemplary embodiment of the collecting tank 6. The refrigerant is introduced into the collecting tank 6 from the condensation region 12 through the inlet opening 18, and the refrigerant is discharged from the collecting tank 6 into the supercooling region 13 through the outlet opening 19. Here, the supercooling region 13 is formed above the superheat region 11 and the condensation region 12, such that the inlet opening 18 and the outlet opening 19 are formed in the upper region of the collecting tank 6. The refrigerant introduced through the inlet opening 18 flows firstly into an inlet chamber 26. Here, the inlet chamber 26 is delimited not only by the side wall 20 of the collecting tank 6 but also by a first separating disk 38 and a second separating disk 39 composed preferably of metal or plastic. The refrigerant flows from the inlet chamber 26 into an accumulator chamber 28 through a descending tube 27. Here, the lower end of the descending tube 27 is formed so as to be arranged below the liquid surface of the refrigerant in the accumulator chamber 28. An ascending tube 25 ends in the lower region of the accumulator chamber 28. The refrigerant flows upward through the ascending tube 25 into an outlet chamber 24. Here, the outlet opening 19 issues into the outlet chamber 24, through which outlet opening the refrigerant flows out of the outlet chamber 24. Here, the outlet chamber 24 is delimited by the side wall 20, the top wall 21 and the first separating disk 38. The spacing between the first and second separating disks 38, 39 lies in a range between 5 and 20 mm. A horizontal section through the collecting tank 6 corresponds to a section through the collecting tank 6 perpendicular to the drawing plane in FIG. 3, 4 or 5.

Dryer granulate 15 as a dryer 14 is arranged within the inlet chamber 26 and the outlet chamber 24. The dryer granulate 15 serves, owing to its hygroscopic properties, to absorb water from the refrigerant. Owing to the geometry of the two separating disks 38, 39, of the top wall 21 and of the side wall 20 and owing to the orientation thereof relative to one another, the inlet chamber 26 and the outlet chamber 24 have a certain volume. Here, a flow space for the refrigerant in the inlet chamber 26 and in the outlet chamber 24 is regarded as being that volume which is available for the refrigerant to flow in. Said flow space is thus the geometric volume of the inlet and outlet chambers 26, 24 minus the volume of the dryer granulate 15. The accumulator chamber 28 corresponds to the interior space enclosed by the collecting tank 6 minus the outlet and inlet chambers 24, 26, the ascending tube 25 and the descending tube 27. Here, the accumulator chamber 28 has a volume V0. The volume V1 of the inlet chamber 26 corresponds to the volume or the space between the first and second separating disks 38, 39 and the side walls 20 minus the volume of the dryer granulate 15, that is to say the volume V1 of the inlet chamber 26 corresponds to the flow space of the inlet chamber 26. Analogously, the volume V4 of the outlet chamber 24 corresponds to the space or volume enclosed between the top wall 21 and the first separating disk 38 and by the side wall 20 minus the volume of the dryer granulate 15 within the outlet chamber 24, such that the volume V4 of the outlet chamber 24 corresponds to the flow space of the refrigerant within the outlet chamber 24. The volume V2 is the flow space enclosed by the descending tube 27, and the volume V3 is the flow space, enclosed by the ascending tube 25, for conducting the refrigerant. Here, a screen or a grate is arranged between the outlet chamber 24 and the ascending tube 25, such that the dryer granulate 15 cannot pass (not illustrated) from the outlet chamber 24 into the ascending tube 25. Analogously, a grate or a screen is also arranged at the top end of the descending tube 27. Here, (V1+V2+V3+V4)/L is less than 170. Here, the volumes V1, V2, V3 and V4 are measured in cubic millimeters ($mm^3$) and the height L of the collecting tank 6 is measured in millimeters (mm). The ratio or the result of the division thus has the unit of square millimeters ($mm^2$). As a result, the volume of the flow spaces of the collecting tank 6 is small, such that only a small amount of the expensive refrigerant need be stored in the flow spaces of the collecting tank 6, specifically in the volumes V1, V2, V3 and V4. Here, the descending tube 27 and the ascending tube 25 are produced from plastic by extrusion and have an inner diameter in the range between 3 and 5 mm. As a result, the volumes V2 and V3 of the ascending tube 25 and of the descending tube 27 are also very small. Furthermore, the inner diameter of the collecting tank 6 is also small, in the range between 10 and 30 mm, in particular in the range between 5 and 25 mm, such that the collecting tank 6 advantageously requires a small installation space, and a small amount of material is required for producing the outer walls of the collecting tank 6, and furthermore, the volume V0 of the accumulator chamber 28 is also small as a result.

Figure 4:
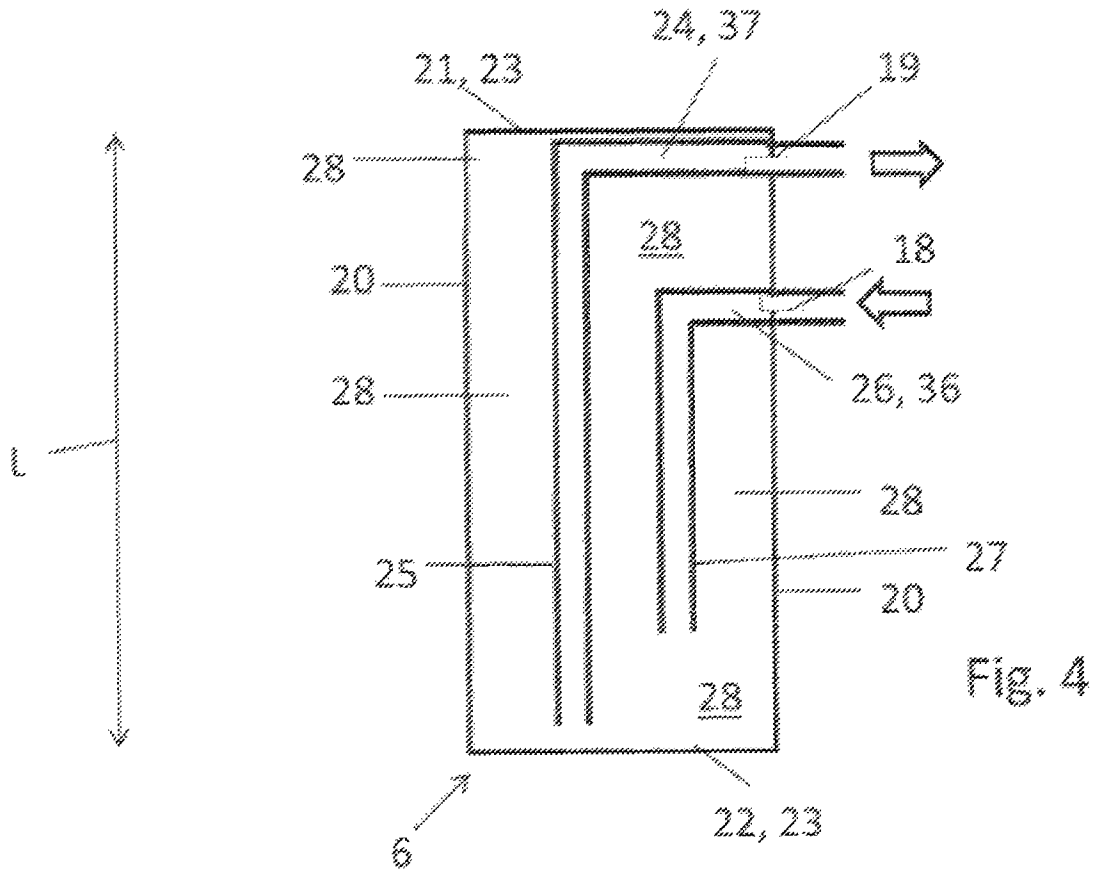
FIG. 4 shows a longitudinal section of the collecting tank in a second exemplary embodiment.

FIG. 4 illustrates a second exemplary embodiment of the collecting tank 6. Substantially only the differences in relation to the first exemplary embodiment as per FIG. 3 will be described below. The inlet chamber 26 is formed not as a space delimited entirely laterally by the side wall 20 but rather merely as an inlet tube 36. This also applies analogously to the outlet chamber 24, which is in the form of an outlet tube 37. It is preferable here for the diameter or the flow cross-sectional area of the inlet tube 36 to correspond to the descending tube 27, and/or for the flow cross-sectional area or the diameter of the outlet tube 37 to correspond to that of the ascending tube 25. As a result, it is the case in the second exemplary embodiment as per FIG. 4, too, that the inlet chamber 26 has a small volume V1 and the outlet chamber 24 has a small volume V4, wherein no dryer granulate 15 is arranged within the inlet and outlet chambers 26, 24. Here, the inlet tube 36 and/or the outlet tube 37 are/is sealed off with respect to the side wall 20 at the inlet opening 18 and at the outlet opening 19 by means of a seal, for example an O-ring seal or a capillary gap, or by means of a labyrinth seal. The dryer granulate 15 is arranged (not illustrated) in the accumulator chamber 28.

Figure 5:
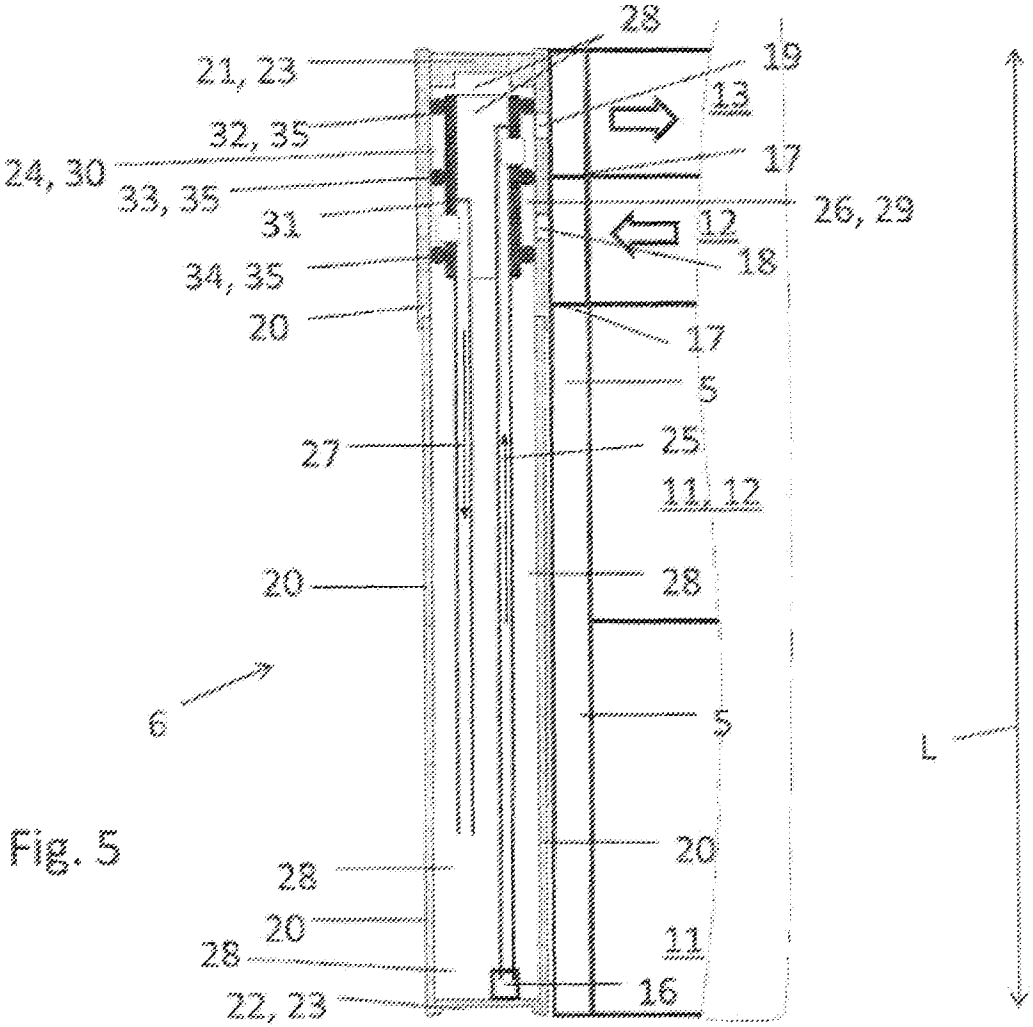
FIG. 5 shows a longitudinal section of the collecting tank in a third exemplary embodiment with a collecting tube.

FIG. 5 illustrates a third exemplary embodiment of the collecting tank 6. Substantially only the differences in relation to the first and second exemplary embodiments of the collecting tank 6 will be described below. The side wall 20 is of two-row form and has a first part in the upper third and has a second part in the lower third. Here, the inlet and outlet openings 18, 19 are provided in the upper third of the side wall 20. A tube piece 31 which is of circular cross section is arranged concentrically within the upper third of the side wall 20 which is of circular form in cross section. Here, an upper sealing ring 32, a middle sealing ring 33 and a lower sealing ring 34, in each case as a seal 35 and composed for example of an elastic plastic or rubber, are arranged between the tube piece 31 and the upper third of the side wall 20. As a result, the outlet chamber 24 is formed as an outlet annular chamber, and the inlet chamber 26 is formed as an inlet annular chamber 29, between the side wall 20 and the tube piece 31. The inlet opening 18 issues into the inlet annular chamber 29 and the outlet opening 19 issues into the outlet annular chamber 30. Here, the tube piece 31 is produced by means of injection molding, for example from metal or plastic, and on said injection-molded part there are simultaneously also formed connection pieces for the connection of the descending tube 27 and of the ascending tube 25. The ascending tube 25 and the descending tube 27 are produced from plastic or metal and with a very small flow cross-sectional area. Owing to said integrally molded connection pieces on the tube piece 31, the ascending and descending tubes 25, 27 can be easily connected in a fluid-tight manner to said connection pieces. Here, the tube piece 31 has corresponding openings such that the refrigerant can flow from the ascending tube 25 into the outlet annular chamber 30 and can flow from the inlet annular chamber 29 into the descending tube 27. A filter 16 is arranged on the lower end of the ascending tube 25. The dryer granulate 15 is arranged (not illustrated) in the accumulator chamber 28.

Also illustrated in simplified form in FIG. 5 are the collecting tube 5 and the superheat region 11, the condensation region 12 and the supercooling region 13. Also illustrated in highly schematic form on the collecting tube 5 are the guiding plates 17 for guiding the flow of the refrigerant through the cooling tubes 2. The cooling tubes 2 are not shown separately in FIG. 5. Here, the superheat region 11 is arranged at the very bottom of the refrigerant condenser assembly 1, the condensation region 12 is arranged above said superheat region, and the supercooling region 13 is arranged at the top. Here, the refrigerant flows from the condensation region 12 into the inlet opening 18 and from the outlet opening 19 of the collecting tank 6 into the supercooling region 13 arranged at the very top. The arrangement of the supercooling region 13 at the very top of the heat exchanger of the refrigerant condenser assembly 1 may be necessary for design reasons within a motor vehicle, for example if a charge-air cooler is arranged in front of the refrigerant condenser assembly 1 in the lower region.

Here, the volume V1 of the inlet annular chamber 29 and the volume V4 of the outlet annular chamber 30 are configured to be as small as possible, or minimal for the smallest value in terms of flow. In the third exemplary embodiment as per FIG. 5 and in the second exemplary embodiment as per FIG. 4, the accumulator chamber 28 extends all the way between the top wall 21 and the base wall 22. Only in the first exemplary embodiment as per FIG. 4 is the accumulator chamber 28 not formed so as to extend up to the upper top wall 21, but rather as a result of separating planes, specifically the inlet chamber 26 and the outlet chamber 24, the accumulator chamber 28 ends at the second separating disk 39.

Here, in the third exemplary embodiment as per FIG. 5, the tube piece 31 may also be arranged, within the side wall 20, lower down than in the illustration of FIG. 5, without any further design modifications being necessary for this purpose. Merely the inlet and outlet openings 18, 19 and the length of the ascending and descending tubes 25, 27 need be correspondingly adapted. It is thus possible by means of a substantially only slightly modified collecting tank 6 to produce refrigerant condenser assemblies 1 with different sizes of supercooling region 13.

Viewed as a whole, the refrigerant condenser assembly 1 according to the invention is associated with significant advantages. The volume of the flow spaces, specifically the volume V1 of the inlet chamber 26, the volume V2 of the descending tube 27, the volume V3 of the ascending tube 25 and the volume V4 of the outlet chamber 24, is small, in particular in relation to the height L of the collecting tank 6. As a result, during operation in a motor vehicle air-conditioning system, the collecting tank 6 requires only a small amount of refrigerant in said flow spaces, such that as a result, the costs for the production of the motor vehicle air-conditioning system with the expensive refrigerant HFO 1234yf can be reduced, because only a small amount of refrigerant is required for filling the collecting tank 6.

LIST OF REFERENCE SYMBOLS

1 Refrigerant condenser assembly
2 Cooling tube
3 Flat tube
4 Corrugated fin
5 Collecting tube
6 Collecting tank
7 Closure plug on the collecting tank
8 Fastening device
9 Assembly inlet opening
10 Assembly outlet opening
11 Superheat region
12 Condensation region
13 Supercooling region
14 Dryer
15 Dryer granulate
16 Filter
17 Guiding plate
18 Inlet opening
19 Outlet opening
20 Side wall
21 Upper top wall
22 Lower base wall
23 Closure plug
24 Outlet chamber
25 Ascending tube
26 Inlet chamber
27 Descending tube
28 Accumulator chamber
29 Inlet annular chamber
30 Outlet annular chamber
31 Tube piece
32 Upper sealing ring
33 Middle sealing ring
34 Lower sealing ring
35 Seal
36 Inlet tube
37 Outlet tube
38 First separating disks
39 Second separating disk
L Height of the collecting tank

The invention claimed is:

1. A refrigerant condenser assembly for a motor vehicle air-conditioning system, comprising cooling tubes for conducting a refrigerant, two collecting tubes for fluidically connecting the cooling tubes, a collecting tank comprising an upper top wall, a lower base wall, a side wall, an inlet opening, an outlet opening, an outlet chamber, an inlet chamber, an ascending tube, a descending tube, and a tube piece wherein the tube piece comprises an upper sealing ring, a middle sealing ring, a lower sealing ring, and a tube piece wall, wherein the inlet chamber is bounded by the middle sealing ring, the lower sealing ring, the side wall, and the tube piece side wall, wherein the outlet chamber is bounded by the upper sealing ring, the middle sealing ring, the side wall, and the tube piece side wall, wherein the inlet opening introduces the refrigerant into the collecting tank, wherein the outlet opening discharges the refrigerant from the collecting tank, wherein the inlet opening and the outlet opening fluidically connect the collecting tank to one of the two collecting tubes or to the cooling tubes, wherein the outlet opening is arranged on a side of the outlet chamber, wherein the outlet chamber is connected to the ascending tube through a first hole in the tube piece wall, wherein an accumulator chamber for the refrigerant is formed within the collecting tank and outside the outlet chamber, the inlet chamber, the ascending tube, and the descending tube, wherein the inlet opening is arranged on a side of the inlet chamber, wherein the inlet chamber is connected to the descending tube through a second hole in the tube piece wall, wherein the cooling tubes comprise a superheat region for cooling a vaporous refrigerant, a condensation region for condensing the vaporous refrigerant, and a supercooling region for cooling a liquid refrigerant, wherein the supercooling region is formed above the superheat region and above the condensation region, wherein the height of the accumulator chamber is greater, than the spacing between the lower base wall and the inlet opening or the outlet opening, wherein the ratio of the sum of the volume measured in $mm^3$ of the inlet chamber ($V_1$), the outlet chamber ($V_4$), the descending tube ($V_2$) and the ascending tube ($V_3$) to the height of the collecting tank (L) measured in mm is provided by the following equation:

$$\frac{V_1 + V_2 + V_3 + V_4}{L} < 100.$$

2. The refrigerant condenser assembly as claimed in claim 1, wherein the cooling tubes are in the form of flat tubes, wherein corrugated fins are formed between the cooling tubes, wherein the upper top wall or the lower base wall is formed as a closure plug, wherein the outlet opening is connected to issues into the supercooling region, wherein the inlet opening is connected to the condensation region.

3. The refrigerant condenser assembly as claimed in claim 1, wherein the accumulator chamber extends from the upper top wall to the lower base wall.

4. The refrigerant condenser assembly as claimed in claim 1, wherein, in a horizontal section at the inlet opening, the accumulator chamber is formed at said horizontal section, or in a horizontal section at the outlet opening, the accumulator chamber is formed at said horizontal section.

5. The refrigerant condenser assembly as claimed in claim 1, wherein a flow cross-sectional area of the ascending tube or a flow cross-sectional area of the descending tube is less than 200 $mm^2$, wherein the inner diameter of the ascending tube or the inner diameter of the descending tube is less than 8 mm.

6. The refrigerant condenser assembly as claimed in claim 1, wherein the inlet chamber is formed as a first inlet annular chamber, wherein the outlet chamber is formed as an outlet annular chamber, wherein at least two seals are arranged between the side wall and a tube piece, to provide sealing between the inlet annular chamber and the accumulator chamber, between the outlet annular chamber and the accumulator chamber, or between the inlet annular chamber and the outlet annular chamber.

7. The refrigerant condenser assembly as claimed in claim 1, wherein a filter is arranged on a lower end of the ascending tube.

8. A motor vehicle air-conditioning system, comprising the refrigerant condenser assembly according to claim 1, an evaporator, a compressor, a fan, a housing for accommodating the fan and the evaporator, and a heating device.

* * * * *